US009631249B2

(12) United States Patent
Adachi et al.

(10) Patent No.: US 9,631,249 B2
(45) Date of Patent: Apr. 25, 2017

(54) STAINLESS STEEL AND METHOD FOR MANUFACTURING SAME

(71) Applicant: NIPPON STEEL & SUMITOMO METAL CORPORATION, Tokyo (JP)

(72) Inventors: Kazuhiko Adachi, Tokyo (JP); Takashi Maeda, Tokyo (JP); Masayuki Shibuya, Tokyo (JP); Kazuyoshi Fujisawa, Tokyo (JP); Yuuichi Fukumura, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 343 days.

(21) Appl. No.: 14/361,080

(22) PCT Filed: Oct. 22, 2012

(86) PCT No.: PCT/JP2012/077178
§ 371 (c)(1),
(2) Date: May 28, 2014

(87) PCT Pub. No.: WO2013/080699
PCT Pub. Date: Jun. 6, 2013

(65) Prior Publication Data

US 2014/0299239 A1 Oct. 9, 2014

(30) Foreign Application Priority Data

Nov. 28, 2011 (JP) ..... 2011-259031

(51) Int. Cl.
*C21D 8/00* (2006.01)
*B21B 3/02* (2006.01)
(Continued)

(52) U.S. Cl.
CPC ..... *C21D 8/005* (2013.01); *B21B 3/02* (2013.01); *C21D 1/18* (2013.01); *C21D 1/185* (2013.01);
(Continued)

(58) Field of Classification Search
CPC .. B21B 3/02; C21D 1/18; C21D 1/185; C21D 2211/005; C21D 2211/008; C21D 6/002;
(Continued)

(56) References Cited

U.S. PATENT DOCUMENTS 2,808,353 A * 10/1957 Leffingwell ..... C21D 8/0405 148/610
4,067,756 A * 1/1978 Koo ..... C21D 1/185 148/320

FOREIGN PATENT DOCUMENTS

EP 0 682 122 11/1995
EP 0 944 199 12/2005
(Continued)

*Primary Examiner* — Jessee Roe
*Assistant Examiner* — Nicholas Wang
(74) *Attorney, Agent, or Firm* — Clark & Brody

(57) ABSTRACT

Martensitic mixed phase stainless steel, which has in well balance between excellent strength and formability and excellent fatigue properties, and is inexpensive, and suitable for spring members, has: a chemical composition comprising C: 0.1-0.4%, Si: at most 2.0%, Mn: 0.1-6.0%, Cr: 10.0-28.0%, N: at most 0.17%, the remainder of Fe and impurities, and a metallurgical structure which includes a ferrite phase and a martensitic phase, and also a retained austenite phase of 5 volume % or less if necessary, and which satisfies a relationship of $C_M/C_F \geq 5.0$ where an average value $C_F$ of C content existing in the ferrite phase, and an average value $C_M$ of C content existing in the martensite.

4 Claims, 1 Drawing Sheet

A-PHASE = AUSTENITE PHASE F-PHASE = FERRITE PHASE

(51) Int. Cl.

| | |
|---|---|
| ***C21D 9/46*** | (2006.01) |
| ***C22C 38/38*** | (2006.01) |
| ***C22C 38/00*** | (2006.01) |
| ***C22C 38/02*** | (2006.01) |
| ***C22C 38/04*** | (2006.01) |
| ***C22C 38/20*** | (2006.01) |
| ***C22C 38/24*** | (2006.01) |
| ***C22C 38/26*** | (2006.01) |
| ***C22C 38/28*** | (2006.01) |
| ***C22C 38/40*** | (2006.01) |
| ***C21D 6/00*** | (2006.01) |
| ***C21D 1/18*** | (2006.01) |
| ***C22C 38/34*** | (2006.01) |
| ***C22C 38/42*** | (2006.01) |
| ***C22C 38/46*** | (2006.01) |
| ***C22C 38/48*** | (2006.01) |
| ***C22C 38/50*** | (2006.01) |
| *C21D 8/02* | (2006.01) |

(52) U.S. Cl.

CPC ..... *C21D 6/002* (2013.01); *C21D 8/0247* (2013.01); *C21D 9/46* (2013.01); *C22C 38/001* (2013.01); *C22C 38/02* (2013.01); *C22C 38/04* (2013.01); *C22C 38/20* (2013.01); *C22C 38/24* (2013.01); *C22C 38/26* (2013.01); *C22C 38/28* (2013.01); *C22C 38/34* (2013.01); *C22C 38/38* (2013.01); *C22C 38/40* (2013.01); *C22C 38/42* (2013.01); *C22C 38/46* (2013.01); *C22C 38/48* (2013.01); *C22C 38/50* (2013.01); *C21D 8/0226* (2013.01); *C21D 8/0236* (2013.01); *C21D 2211/005* (2013.01); *C21D 2211/008* (2013.01)

(58) Field of Classification Search

CPC .... C21D 8/005; C21D 8/0226; C21D 8/0236; C21D 8/0247; C21D 9/46; C22C 38/00; C22C 38/001; C22C 38/02; C22C 38/04

See application file for complete search history.

(56) References Cited

FOREIGN PATENT DOCUMENTS

| | | | |
|---|---|---|---|
| JP | 3363590 | | 10/2002 |
| JP | 2003-089851 | | 3/2003 |
| JP | 2004244691 | * | 2/2004 |
| JP | 2004-244691 | | 9/2004 |
| JP | 3602201 | | 10/2004 |
| JP | 2004-323960 | | 11/2004 |
| JP | 2004323960 | * | 11/2004 |
| JP | 2005-179772 | | 7/2005 |
| JP | 2005179772 | * | 7/2005 |
| JP | 2008-297602 | | 12/2008 |
| JP | 4252893 | | 1/2009 |
| JP | 4353060 | | 8/2009 |

* cited by examiner

A-PHASE = AUSTENITE PHASE F-PHASE = FERRITE PHASE

STAINLESS STEEL AND METHOD FOR MANUFACTURING SAME

TECHNICAL FIELD

The present invention relates to stainless steel and a method for manufacturing the stainless steel excellent in formability while maintaining a high strength, and thus excellent in balance between the strength and the formability, and also excellent in fatigue properties. The stainless steel according to the present invention is applicable to various products, and particularly applicable to starting materials of various components, in which a high strength is required because of current progress in size reduction and weight reduction, and which are formed into particular shapes.

The components herein mean components of end products used by consumers, such as automobiles, household electric appliances, personal computers, and mobile phones. Specifically, engine gasket for an automobile, rings for continuously variable transmissions, housing for personal computers or mobile phones, and belleville springs installed beneath buttons of the personal computers or the mobile phones may be the most suitable components.

BACKGROUND ART

As stated above, a wide variety of components are used in end products. Higher strength has further been required in starting materials of those components on order to prevent deterioration of rigidity due to recent progress in size reduction and weight reduction (reduction in plate thickness or reduction in cross sectional area) of products. Size reduction and weight reduction of products and components result in efficient utilization of precious resources, and also contribute to environmental problems solution. Meanwhile, complication and high preciseness in shapes of components have been pursued, and thus starting materials having excellent formability is also required.

In such requirements, high strengthening in conventional metallic materials inevitably results deterioration of formability, and high strength is inconsistent with excellent formability. A spring is subject to repetitive deformation, and often undergoes fatigue failure at an early stage due to local concentration of stress. Hence, a need for materials for spring members having high strength and excellent formability and fatigue resistance increases.

In general, one of biggest feature of stainless steel is excellent corrosion resistance, and stainless steel has been used as a starting material for spring members. Specifically, metastable austenitic stainless steel such as SUS301 and SUS304 has been commonly used as a starting material for spring members. This is because, in the metastable austenitic stainless steel, transformation from an austenitic parent phase into a rigid martensitic phase (deformation-induced martensitic transformation) is caused by cold working, so that high strength can be relatively easily obtained, and the strength can be adjusted in a wide range.

The metastable austenitic stainless steel is excellent in formability because its austenitic parent phase exhibits high elongation, and deformed regions become hardened through transformation into the martensitic phase, as stated above, and soft non-deformed regions are more likely to be deformed, by which the entire material becomes uniformly deformed (TRIP effects), so that excellent formability is exhibited as well. Because of the above features, the metastable austenitic stainless steel is classified as a stainless steel strip for a spring in JIS Standard (JIS-G-4313), and its mechanical property is also specified by JIS Standard.

A degree of work hardening exhibited by the metastable austenitic stainless steel changes with various factors, which often makes it difficult to stably obtain desired properties with a desired plate thickness of a product. It is also a problem that load charged especially at the time of rolling increases because of demands of thinner plate and higher strength for addressing the current needs of size reduction and weight reduction of spring members. Further, the metastable austenitic stainless steel contains a plenty of Ni that is an expensive and rear alloy element and hence is expensive.

Meanwhile, martensitic stainless steel, such as SUS403, SUS 410, and SUS420, in which high strength is obtained through transformation into a hard martensitic phase as an intermediate phase by heat treatment (quenching), is employed as a starting material for spring members. In addition, martensitic stainless steel is often used as a starting material for utilizing a mixed phase structure in combination with a ferrite phase. These stainless steels hardly contain Ni; therefore, it is more inexpensive than the above metastable austenitic stainless steel.

As the above-stated martensitic stainless steel, Patent Document 1 discloses a high strength stainless steel with a composite phase structure; Patent Document 2 discloses a high strength dual phase stainless steel strip or sheet; Patent Document 3 discloses a high strength double phase stainless steel strip for a steel belt; Patent Document 4 discloses a mixed phase stainless steel for a gasket; Patent Document 5 discloses a high strength duplex stainless steel sheet having high elasticity, and Patent Document 6 discloses a high-strength stainless steel plate having excellent ductility.

PRIOR ART DOCUMENT

Patent Document

Patent Document 1: Japanese Patent No. 3363590
Patent Document 2: Japanese Patent No. 3602201
Patent Document 3: Japanese Patent No. 4252893
Patent Document 4: Japanese Patent No. 4353060
Patent Document 5: Japanese Patent JP 2003-89851
Patent Document 6: Japanese Patent .JP 2004-323960

SUMMARY OF INVENTION

Unfortunately, even in the mixed phase martensitic stainless steel in the above cases, it is difficult to adjust strength of the steel to be predetermined strength, and this adjustment of strength becomes more difficult as strength progresses.

In addition, the martensitic stainless steel is required to have much higher strength and more excellent elongation as well as more excellent fatigue properties because of current size reduction and weight reduction of spring members.

An object of the present invention is to provide stainless steel and a method for manufacturing the stainless steel in which formability is enhanced as well as high strength is obtained, and which is excellent in fatigue properties, also adjustable to predetermined strength, and relatively inexpensive.

Another object of the present invention is to provide martensitic stainless steel with a mixed phase structure and a method for manufacturing the martensitic stainless steel, which has more excellent performance and reliability in comparison with the prior arts, provides stable industrial supply, and is applicable to components of the aforementioned end products, specifically, gaskets used in engines of automobiles, rings for continuously variable transmissions, housing for personal computers or mobile phones, and Belleville springs embedded under keys of the personal computers or the mobile phones. Accordingly, it is possible to provide a technique of promoting effective utilization of resources by size reduction and weight reduction of products, and contributing to improvement of environmental problems.

According to one aspect, the present invention is stainless steel characterized by having: a chemical composition comprising C: 0.1-0.4% (in this description, unless otherwise specified, percent with respect to chemical composition means mass percent), Si: 2.0% or less, Mn: 0.1-6.0%, Cr: 10.0-28.0%, N: at most 0.17%, a remainder of Fe and impurities; and by having a metallurgical structure of a mixed phase structure of a ferrite phase and a martensitic phase, and also a retained austenite phase of at most 5% in volume % if necessary, and satisfying a relationship of $C_M/C_F \geq 5.0$ where an average of C content existing in the ferrite phase is defined as $C_F$, an average of C content existing in the martensitic phase is defined as $C_M$.

Preferably, an average grain diameter of the mixed phase structure is at most 10 μm.

The chemical composition may further contain, in place of a portion of Fe, one or two types of elements selected from Ni: at most 2% and Cu: at most 2%, and/or one or more types of elements selected from Nb: at most 0.5%, V: at most 0.5%, and Ti: at most 0.5% s.

From another aspect, the present invention is a method for manufacturing stainless steel characterized by having: the chemical composition, the method characterized by subjecting the stainless steel to hot and cold working, and subsequent heat treatment at least once respectively; and thereafter to final cold working into a product shape, and subsequent final heat treatment for performance adjustment, wherein the method is characterized by: carrying out heat treatment prior to the final cold working by holding the stainless steel under heating in an austenite single-phase region for at least ten minutes, and subsequently holding the stainless steel under heating in a ferrite single-phase region for at least one minute and carrying out the final heat treatment after the final cold working by holding the stainless steel under heating in a dual phase region of a ferrite phase and an austenite phase within a range of 800-1000° C. for at least ten seconds, and subsequently cooling the stainless steel at a cooling rate of at least 1° C./second down to at least 600° C.

The stainless steel according to the present invention is inexpensive stainless steel which does not contain plenty of Ni, but is excellent in formability as well as obtaining high strength (maintaining well balance between high strength and high formability), and also excellent in fatigue properties. This stainless steel can be suitably used as a starting material of components of the aforementioned various end products. The method for manufacturing according to the present invention enables industrially stable supply of mixed phase stainless steel characterized by a martensitic phase and a ferrite phase, which has more excellent performance and more reliability in comparison with the prior arts. Accordingly, it is possible to promote effective utilization of resources through size reduction and weight reduction of products, and contribute to improvement of environmental problems.

DESCRIPTION OF EMBODIMENT

Figure 1:
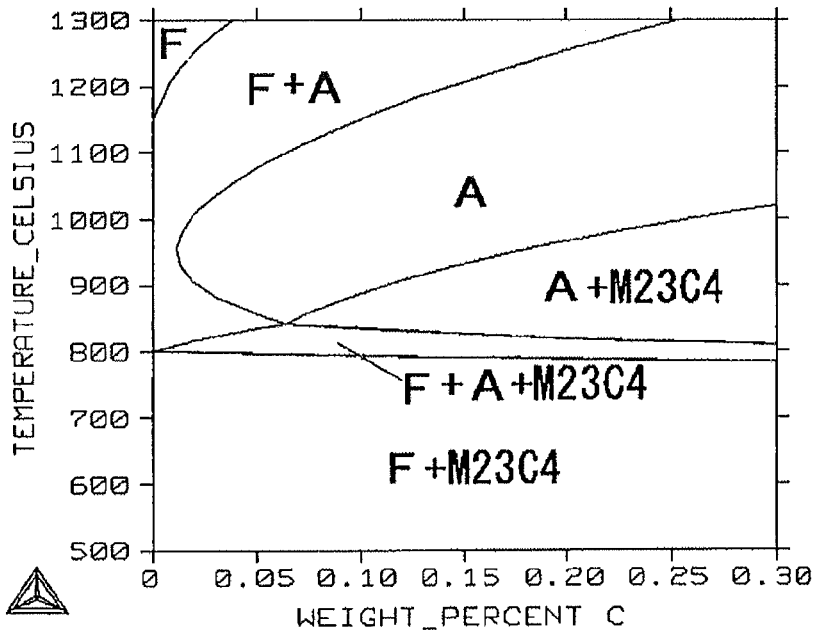
FIG. 1 is a calculated phase diagram of 12.5Cr-0.5Mn—C steel.

The present invention will be explained in greater detail while referring to the attached drawings. In the following description, a stainless steel plate is explained as stainless steel, namely, rolling is explained as both hot working and cold working. The present invention, however, is not limited to the case in which the stainless steel is a steel plate. The stainless steel may be a bar, a tube blank, or a profile, for example, and thus the hot working and the cold working may be extrusion, grooved rolling, or the like, for example.

1. Findings Underlying the Present Invention

As stated above, an object of the present invention is stable industrial supply of high strength mixed phase martensitic stainless steel suitable for spring members in which size reduction and weight reduction are further desired, and also having excellent elongation and fatigue properties. The present invention has been achieved based on the following findings A to H as well as a number of tests.

(A) Strength of a martensitic stainless steel plate is proportional to contents of C and N that are interstitial type solid-solution strengthening elements, and becomes increased by containing C and N with high concentration in the martensitic phase.

(B) In order to obtain both stable high strength and excellent elongation, it is effective that the strength is obtained in the martensitic phase, and the elongation is obtained in the ferrite phase that may be soft. As a result of the obtaining both the high strength and the elongation, excellent fatigue properties is obtained after the steel is formed into a component shape.

(C) The desired excellent performance is obtained by adjusting the C and N contents to be great in the martensitic phase, and also adjusting the C and N contents to be small in the ferrite phase, thereby adjusting the ratio of the C and N contents between the both phases to be great.

(D) In the martensitic phase to obtain the strength, C is more effective than N in order to obtain greater elongation in a high strength region.

(E) In order to dissolve a large amount of C in the martensitic phase in solid, it is required to increase amount of C provided in the austenite phase at the time of holding the steel under heating in the final heat treatment in the dual phase region. Coarse carbide not only deteriorates the elongation, but also requires a longer time for solid solution in the final heat treatment, so that the amount of C provided in the austenite phase becomes decreased. To avoid this, it is effective to refine carbide before the final heat treatment so as to easily solve the carbide at the time of the final heat treatment in solid.

(F) Refining of the carbide is obtained by once dissolving the coarse carbide formed by hot rolling or the like, and subsequently adjusting precipitation thereof.

(G) Meanwhile, in the mixed phase martensitic stainless steel, well balance between the strength and the elongation and the excellent fatigue properties can be achieved by grain refining. Dual phase annealing at a lower temperature is effective for the grain refining, and containing an austenite stabilizing element Mn, Ni, or Cu increases the dual phase region at a higher temperature, which enables annealing from a lower temperature, resulting in contribution to the grain refining. Containing compositional elements of the precipitate, such as Nb, V and Ti, which suppresses grain growth, is also effective for the grain refining.

(H) Based on results of tests carried out by the present inventors, they found that the austenite stabilizing element Mn was most effective for obtaining great elongation in the high strength region.

Using martensitic stainless steel mainly including high C and Mn contents as a starting material, studies have been carried out on influences of chemical compositions and heat treatment conditions for stably obtaining a desired high strength; and as a result, it was found that the following two points were important.

(I) It is effective to adjust both high strength obtained by dissolving a greater amount of a solid solution strengthening element into the martensitic phase in solid and greater elongation obtained by reducing a solid solution strengthening element in the ferrite phase that may be soft.

(J) It is effective to enlarge the temperature range (reducing inclination in the strength adjusting range) where performance adjustment is carried out by heat treatment (quenching) using the austenite stabilizing element Mn.

Regarding the above (I), both high strength and greater elongation can be adjusted well by carrying out solid solution heat treatment of holding the steel under heating in the austenite single phase before the final cold rolling so as to completely dissolve the carbide in solid, and thereafter, holding the steel in the ferrite phase region at a lower temperature, thereby finely precipitating dissolved C supersaturated due to great decrease of the solid solubility, as the carbide. This heat treatment may be carried out by the final cold rolling, but it is simpler to carry out this treatment as the solid solution heat treatment after the hot rolling. Refine precipitation of the carbide by this heat treatment reduces amount of dissolved C in solid, thereby suppressing the martensitic transformation during cooling, and thus the material becomes softened. As a result, the subsequent cold rolling can be carried out. Through the cold rolling, the carbide that has finely precipitated in the ferrite phase region at a lower temperature can be pulverized into further refined carbide. In this manner, the refined carbide is re-dissolved and distributed through holding in the dual phase region in the final heat treatment, thereby achieving both high strength and greater elongation as indicated in the above (I).

The conventional solid solution heat treatment after the hot rolling is carried out in the vicinity of the upper limit temperature in the ferrite phase region. In this case, the solid solution becomes incomplete, and thus coarse carbide remains. Meanwhile, if the solid solution heat treatment is carried out in an austenite single phase temperature range, coarse carbide can be dissolved, but hard martensitic phase is also produced at the time of cooling, resulting in high strength. Consequently, the subsequent cold rolling cannot be carried out; for this reason, the solid solution heat treatment is not accomplished in the austenite single phase temperature range in the prior arts.

Regarding the above (J), the temperature range can be enlarged by adding Mn so as to enlarge the dual phase region toward a lower temperature, and carrying out the final heat treatment at a lower temperature, thereby obtaining grain refining as well.

To be briefly described, the present invention uses stainless steel mainly containing a large amounts of C and Mn, and configures its metallurgical structure to be a mixed phase of the hard martensitic phase and the soft ferrite phase, in which a ratio ($C_M/C_F$) between an average value $C_F$ of amount of C existing in the ferrite phase, and an average value $C_M$ of amount of C existing in the martensitic phase is set to at least be 5.0. By this configuration, it is possible to provide stainless steel having excellent formability as well as obtaining high strength, and also excellent fatigue properties inexpensively.

2. Chemical Composition

The chemical composition of the stainless steel according to the present invention is as follow. A symbol "%" denotes "mass %", as described above. [C: 0.1-0.4%]

C is inexpensive, and the most effective interstitial type solid solution strengthening element, and also an effective element for precipitating a compound with Nb, V, Ti, and suppressing the growth of crystal grains. Hence, the content of C can affect stable exhibition of the target performance of the present invention, and hence should be controlled. The C content is set to be at least 0.1% so as to sufficiently achieve the above effect. Preferably, the content thereof is at least 0.11%, and more preferably at least 0.12%. If the C content is excessive, coarse carbide is formed in combination with Cr, and various properties deteriorate. Accordingly, the C content is set to be at most 0.4%. Preferably, this content is at most 0.38%, and more preferably at most 0.36%.

[Si: At Most 2.0%]

Si is the second most effective solid solution strengthening element after the interstitial type solid solution strengthening element. Si is a ferrite stabilizing element, and its content should be determined taking a balance between the Si and the austenite stabilizing element into consideration. At the same time, Si is also used as a deoxidizer agent at the time of melt refining, and if the Si content is excessive, coarse inclusions are formed, which deteriorate various properties. Accordingly, the Si content is set to be at most 2.0%. Preferably, the Si content is at most 1.8%. In order to obtain the above effect, the Si content is preferably at least 0.1%.

[Mn: 0.1-6.0%]

Mn is an austenite stabilizing element, and enlarges the dual phase region including the austenite phase at a high temperature and the ferrite phase. Accordingly, quenching at a lower temperature can be carried out, adjustment of strength becomes easier, and high performance can be obtained by grain refining because of lowering of the quenching temperature. In addition, as an effect of quenching at a lower temperature, Mn enhances the elongation due to decrease of the solid solubility for C and N in the ferrite phase, and at the same time, strengthens the martensitic phase due to increase in amount of solid solution of C and N. As a result, it is possible to obtain the high strength and the excellent elongation at the same time. Mn is an essential element for achieving the important effect in the present invention, and the Mn content is set to be at least 0.1%. Preferably, the content thereof is at least 0.3%. If the Mn content is excessive, coarse Mn compounds are formed, and various properties deteriorate. Accordingly, the Mn content is set to be at most 6.0%. Preferably, the Mn content is at most 5.6%.

[Cr: 10.0-28.0%]

Cr is one of the basic elements in the stainless steel, and is contained with a content of at least 10.0% for the purpose of obtaining basic corrosion resistance. Preferably, the content thereof is at least 10.2%. Cr is a ferrite stabilizing element, and its content is determined taking a balance between Cr and the austenite stabilizing elements (e.g. Mn) into consideration. if the Cr content is excessive, necessary strength is hindered, and a coarse compound is formed, which deteriorates both the elongation and the fatigue strength. Accordingly, the Cr content is set to be at most 28.0% s. The content thereof is preferably at most 26.0%.

[N: At Most 0.17%]

N is a very strong interstitial type solid solution strengthening element next to C, and is an effective element for precipitating a compound with Nb, V, Ti, thereby suppressing the growth of crystal grains. If the N content is excessive, hot workability significantly deteriorates. Accordingly, the N content is set to be at most 0.17%. Preferably, the content thereof is at most 0.15%. In order to obtain the above effect, the N content is preferably at least 0.01%.

A stainless steel according to the present invention may further contain the following optional elements as necessary.

[One or More Elements Selected from Ni: At Most 2% and Cu: At Most 2%]

Both Ni and Cu are austenite stabilizing elements, and enlarge the dual phase region including the austenite phase at a higher temperature and the ferrite phase, and enable quenching from a lower temperature. Accordingly, for the purpose of complementing the effect of Mn, one or both of Ni and Cu may be contained with a content of at most 2.0%, respectively. Preferably, the Ni content and the Cu content are both at most 1.8%. In order to obtain the above effect, preferably, the Ni content and the Cu content are both at least 0.1%.

[One or More Elements Selected from Nb: At Most 0.5%, V: At Most 0.5%, and Ti: At Most 0.5%]

Nb, V, Ti form a compound with C, N, and suppress the growth of crystal grains by the pinning effect thereof, and thus one or more of these elements may be contained for the sake of the grain refining. Each content of Nb, V, and Ti is set to be at most 0.5%, and preferably at most 0.4%. In order to obtain the above effect, each content of Nb, V, and Ti is preferably at least 0.01%.

The remainder other than the above-described elements is Fe and impurities.

3. Metallurgical Structure

[Mixed Phase Structure Including Ferrite Phase, Martensitic Phase, and Also Retained Austenite Phase of at Most 5% in Volume % if Necessary]

The reason for configuring the metallurgical structure to be a mixed phase structure including the ferrite phase and the martensitic phase is because the excellent elongation is obtained in the soft ferrite phase, and the high strength is obtained in the hard martensitic phase, thereby achieving both excellent elongation and high strength, and also obtaining excellent fatigue properties. In a high-temperature dual phase region, both the ferrite phase and the austenite phase suppress the growth of grains. In the present invention, enlargement of the high-temperature dual phase region toward a lower temperature enables quenching at a lower temperature, and thus it is possible to enhance the properties by the refining of the crystal grains.

The above mixed phase structure is produced by the final heat treatment. The austenite phase, however, may partially remain after the final heat treatment. This means that the metallurgical structure may include a retained austenite phase. The austenite phase exists in a high temperature region, and in general, transforms into the martensitic phase as an intermediate phase, but part of the austenite phase may be maintained without transforming down to the room temperature. The part thereof becomes at most 5% in volume %, and preferable at most 4% in volume %.

FIG. 1 is a calculated phase diagram of 12.5Cr-0.5Mn—C steel that is possibly included in the present invention. Relationship of the ferrite phase, the austenite phase, and the martensitic phase relative to the C content will be explained with reference to FIG. 1.

As shown in FIG. 1, the ferrite phase (F) has a smaller solid solubility for C that is a solid solution strengthening element, and thus is soft. To the contrary, the austenite phase (A) has a greater solid solubility for C that is also an austenite stabilizing element, but is relatively soft after the heat treatment, in general. As specifically shown in FIG. 1, if the C content is 0.15%, and the temperature is up to 1200° C., which is generally used on an industrial basis, for example, the austenite single phase (A) exists down to approximately 940° C. as the temperature decreases, and the austenite phase and the carbide ($A+M_{23}C_4$) exist down to approximately 830° C., and the austenite phase, the ferrite phase, and the carbide ($A+F+M_{23}C_4$) exist down to approximately 790° C., and the ferrite phase and the carbide ($F+M_{23}C_4$) exist at a temperature lower than 790° C. The stable austenite phase in a high temperature region gradually transforms into the ferrite phase while forming the carbide as the amount of carbon, which is dissolved in a low temperature region, decreases.

FIG. 1 shows, however, a stabilized phase formed finally. If the steel is rapidly cooled from the austenite region at a higher temperature during the final heat treatment, the martensitic phase containing a supersaturated amount of C more than the solid solubility limit is produced from the austenite phase. The martensitic phase contains solid solution C almost as much as that of the austenite phase, so that the martensitic phase is hard because of its solid solution strengthening mainly, and contributes to high strengthening. Other reason to obtain the high strength may include strengthening by strains caused by thermal shrinkage upon cooling.

In the present invention, in order to obtain the mixed phase structure including the ferrite phase and the martensitic phase, the steel is cooled from the dual phase region of the ferrite phase and the austenite phase having a lower temperature than that of the austenite region at the time of the final heat treatment. Accordingly, it is possible to obtain both the high strength obtained by the hard martensitic phase and the elongation obtained by the soft ferrite phase. The proportion of the ferrite phase to the martensitic phase does not need to be defined. Either one of them may be a primary phase.

[Ratio of Average Value $C_F$ of C Content Existing in Ferrite Phase and Average Value $C_M$ of C Content Existing in Martensitic Phase ($C_M/C_F$ Ratio): At Least 5.0]

If the ratio of an average value $C_F$ of C content existing in ferrite phase, and an average value $C_F$ of C content existing in martensitic phase ($C_M/C_F$ ratio) is at least 5.0e, an excellent balance between the elongation and the strength can be achieved. By distributing C to the ferrite phase and to the martensitic phase so as to satisfy this ratio, it is possible to obtain the excellent elongation obtained by the soft ferrite phase as well as the high strength obtained by the hard martensitic phase. Preferably, the $C_M/C_F$ ratio is at least 7.0. This C content denotes summed concentration of C contained in the refined carbide excluding coarse carbide causing adverse effect on the concentration of C dissolved in the martensitic phase or the ferrite phase, and on the workability, as described later. The retained austenite phase possibly present in amount of 5% in volume % has almost the same concentration of C as that in the martensitic phase, and thus the retained austenite phase may be represented by the martensitic phase in the discussion of the concentration of C.

The C content existing in the ferrite phase and the C content existing in the martensitic phase are respectively analyzed with EPMA. The measurement conditions are as follows: accelerating voltage of 15 kV, illumination current of $2.5\times10^{-8}$ A, probe diameter of approximately 2 μm, and measurement time at each point of at least 1 second.

The analysis by EPMA is carried out by irradiating an R.D. (rolling direction) parallel cross sectional surface after embedding and polishing with electron beams so as to perform a linear analysis while avoiding overlapping of the measurement points. The measurement points are set to be at least 100 points. Measurement points where coarse precipitates of at least 1 μm are observed are excluded because such points exhibit abnormal C content.

The C content at every measurement point is segregated, measurement values are put in the order of descending priorities, and measurement values at the greatest ten points and the smallest ten points are excluded; and among the rest measurement values of C content, an average value of measurement values at the greatest ten points is defined as $C_M$, and an average value of measurement values at the smallest ten points is defined as $C_F$. The reason for obtaining the average values $C_M$, $C_F$ in this manner is because it is difficult to accurately determine in which phase crystal grains exist by a simple microstructure observation using an optical microscope or the like; therefore, the determination becomes more assured if measurements are conducted on any of a least 100 points, and determination is made based on the measurement result.

The reason for excluding the measurement values at the greatest ten points and the smallest ten points from the segregated measurement values is because such a case may be supposed that no precipitate is observed in the surface, but coarse precipitate exists in the inside, which exhibits an abnormal value, and causes a measurement error. This means that carbide existing inside indicates abnormally large amount of C, as similar to the case of observing the carbide in the surface. In the case of presence of precipitate other than carbide, such as nitride and sulfide, in the steel, the C content rather becomes abnormally small. Influence of such abnormal amount of C can substantially be eliminated by excluding the measurement values at the smallest ten points and the greatest ten points, respectively.

[Average Grain Diameter of Mixed Phase Structure: At Most 10 μm]

In order to obtain a balance between the excellent elongation and the strength as well as excellent fatigue properties by the grain refining, the average grain diameter of the stainless steel according to the present invention is preferably at most 10 μm. More preferably, the average grain diameter of the mixed phase structure is at most 9.6 μm.

4. Method for Manufacturing Stainless Steel

This is a method for manufacturing stainless steel of subjecting stainless steel having the above chemical composition to the hot working and cold working, and subsequent heat treatment respectively at least once in combination therewith, and thereafter, subjecting the steel to the final cold working into a product shape, and also to the final heat treatment for adjustment of the performance.

According to the present invention, prior to the final cold working, the heat treatment is carried out in such a manner that the steel is held under heating in the austenite single phase region for at least ten minutes, and subsequently also held under heating in the ferrite single phase region for at least one minute; and then, the final cold working is carried out; and thereafter, the final heat treatment is carried out in such a manner that the steel is held under heating in the dual phase region of the ferrite phase and the austenite phase within a range of 800-1000° C. for at least 10 seconds, and subsequently, the steel is cooled at a cooling rate of at least 1° C./second down to at least 600° C.

Figure 2:
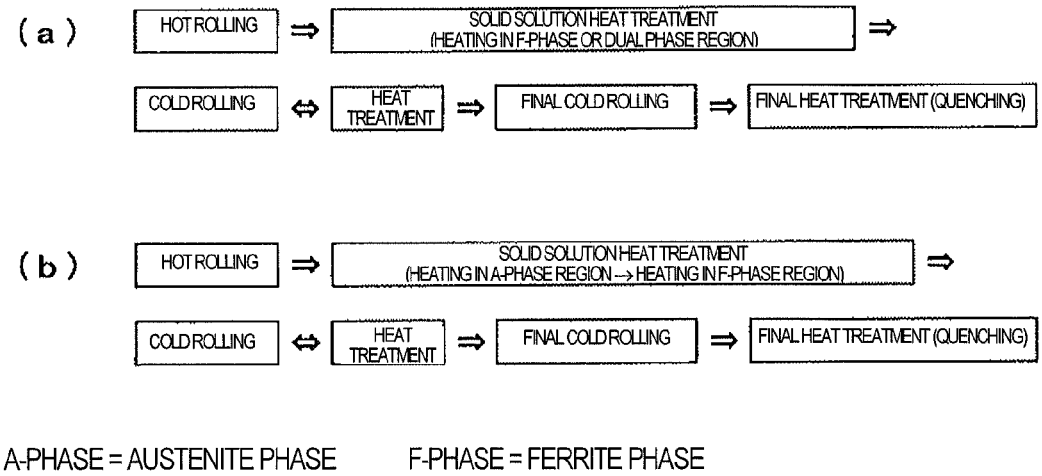
FIG. 2A is an explanatory view showing an example of processing steps of Comparative method employed in Example.
FIG. 2B is an explanatory view showing an example of processing steps of Inventive method employed in Example.

The representative procedure is as shown in FIG. 2B.

Hot rolling (structure control, thickness reduction)→solid solution heat treatment (solid solution of C, N, and adjustment of precipitate)→[cold rolling (thickness reduction)→heat treatment (softening, structure control)]→final cold rolling (thickness reduction to product plate thickness)→final heat treatment=quenching (performance adjustment, structure control)

The hot rolling and the cold rolling may be carried out with a conventional method. Hereinafter, the process of holding the steel under heating in the austenite single phase region for at least ten minutes, and subsequently holding the steel under heating in the ferrite single phase for at least one minute is referred to as solid solution heat treatment; the final cold working process and the final heat treatment process are referred to as final cold working, and as final heat treatment, respectively; and other cold working process and heat treatment process are referred to simply as cold working, and as heat treatment, respectively. According to the present invention, conditions of the solid solution heat treatment and the final heat treatment are defined as sated above.

[Solid Solution Heat Treatment]

In general, the conventional solid solution heat treatment is carried out in the ferrite single phase region, or in the dual phase region of ferrite and austenite in some cases. According to the present invention, the solid solution heat treatment is carried out in such a manner that the steel is held under heating in the austenite single phase region for at least ten minutes, and subsequently, held under heating in the ferrite single phase region for at least one minute.

The reason for holding the steel under heating in the austenite single phase region is because, the solid solubility for the interstitial type solid solution strengthening element (C, N) is significantly greater in the austenite phase than in the ferrite phase, in general. The holding time of at least ten minutes enables these elements to be completely dissolved in solid, and thus the steel is held under heating in this temperature range for at least ten minutes. It should be noted that if coarse carbide and nitride exist after the hot rolling, it is preferable to set the heating temperature to be as high as possible, and or to set the holding time to be as long as possible. The holding time is preferably at least 30 minutes.

The purpose of holding the steel under heating in the ferrite single phase region is to finely precipitate carbide so that the carbide is encouraged to be dissolved at the time of the final heat treatment, and more carbide is dissolved into the austenite phase. Accordingly, the material can be softened enough for reducing load of the subsequent working for thickness reduction. As stated above, the cooling from the austenite single phase region hardens the material by its transformation into the martensitic phase, and thus it becomes impossible to carry out the subsequent cold working. To the contrary, holding the steel under heating in the ferrite single phase region enables C and N dissolved in a supersaturated state to be precipitated as a compound in the ferrite phase because of significant decrease of the solid solubility, which suppresses production of the hard martensitic phase, so that it is possible to perform the subsequent cold rolling. The holding time in the ferrite single phase region is set to be at least one minute. It should be noted that if the interstitial type elements are contained with high concentration, a longer holding time in the ferrite single phase region causes precipitation of coarse compounds; thus it is preferable to set the holding time to be at most 60 minutes. Holding the steel under heating in the ferrite single phase region may be carried out continuously from the heating in the austenite single phase region, or may be carried out after once cooling the steel to the room temperature. In the case of continuously carrying out holding the steel under heating, the steel may be once cooled down to a temperature lower than the heating temperature in the ferrite single phase region so as to increase the supersaturating degree of C, thereby forming a precipitating site of carbide; and subsequently, the temperature is increased, and the steel may be held at a target heating temperature.

The aforementioned solid solution heat treatment of heating in the austenite single-phase region, and then heating in the ferrite single-phase region may be carried out at any heat treatment step before the final cold rolling. In general, it is efficient to carry out this heat treatment as the solid-solution heat treatment after the hot rolling.

In principle, the above heat treatment can also be carried out at the time of the final heat treatment after the final cold working. Specifically, the final heat treatment is carried out in such a manner that the steel is once heated in the austenite single-phase region so as to completely solid-solve the carbide and the like, and thereafter, the steel is held at a temperature in the two-phase region of the ferrite phase and the austenite phase. If the steel is heated up to the austenite single phase region at a higher temperature, crystal grains cannot be prevented from becoming coarse. In addition, if the steel is cooled down to a temperature of the dual phase region of the ferrite phase and the austenite phase, the transformation temperature where the ferrite phase is formed becomes decreased, which causes such a problem of the requirement of temperature control at a high level on the practical basis.

[Final Heat Treatment]

The final heat treatment after the final cold rolling is carried out for quenching. This final heat treatment is carried out in such a manner that the steel is held under heating within a temperature range of 800-1000° C., and also at a temperature within the dual phase region of the ferrite phase and the austenite phase for at least ten seconds, and thereafter, is cooled down to at least 600° C. at a cooling rate of at least 1° C./second.

The reason for, after the final cold rolling, holding the steel under heating at a temperature of at least 800° C. and at most 1000° C. in the dual phase region of the ferrite phase and the austenite phase for at least ten seconds, and thereafter, cooling the steel down to at least 600° C. at a cooling rate of at least 1° C./second is to obtain the aforementioned excellent properties by the heat treatment (quenching) from the dual phase region at a higher temperature. In the case of the higher final heat treatment temperature than 1000° C. or the austenite single phase region, the elongation becomes decreased, and the workability becomes deteriorated, and the fatigue properties also become deteriorated. In order to configure the structure of the material to be a mixed phase structure by the above holding under heating, and to dissolve the refined carbide so as to dissolve carbon into the austenite phase, the holding time of the final heat treatment is set to be at least 10 seconds. Preferably, the holding time is at least 30 seconds.

The purpose of setting the cooling rate after the heating to be at least 1° C./second is to suppress precipitation of a coarse compound during the cooling, thereby obtaining a hard martensitic phase. The cooling rate is preferably at least 3° C./second. In order to obtain stable properties, in principle, the cooling rate is preferably maintained down to approximately 200° C. where the martensitic transformation is completed. In an industrial plant, however, it is difficult to control the cooling rate down to this temperature range, so that the steel is held under heating down to 600° C. for the purpose of suppressing precipitation of coarse carbide. Specifically, the average cooling rate from the heating temperature to 600° C. may be at least 1° C./second, preferably at least 3° C./second.

[Other Procedures]

Cold rolling and heat treatment (annealing) in the ferrite single phase region may be carried out before the final cold rolling if necessary. The cold rolling and the heat treatment may be omitted, or may be carried out twice or more. In the latter case, it is preferable to perform the heat treatment ever time after performing the cold rolling.

The purpose of carrying out the heat treatment in the ferrite single phase region is to prevent the subsequent cold rolling from becoming difficult due to the transformation into the hard martensitic phase.

After the heat treatment in the ferrite single phase region is carried out, the final cold rolling is carried out so as to reduce the plate thickness to a product plate thickness. Precipitate is also refined through this cold rolling. Hence, the rolling reduction in the final cold rolling is preferably at least 30%, more preferably at least 50%.

Example

The present invention will be more specifically described with reference to Example.

Small ingots of inventive steels A-K and of comparative steels L-P, both of which have respective chemical compositions shown in Table 1, were prepared.

TABLE 1

| | Chemical Composition (mass %, Remainder: Fe & Impurities) | | | | | | | | | |
|---|---|---|---|---|---|---|---|---|---|---|
| Steel | C | Si | Mn | Cr | Ni | Cu | Nb | V | Ti | N |
| A | 0.125 | 0.32 | 0.44 | 12.48 | — | — | — | — | — | 0.008 |
| B | 0.131 | 0.34 | 1.48 | 12.37 | 0.29 | — | — | — | — | 0.040 |
| C | 0.360 | 0.37 | 1.51 | 23.60 | — | 0.41 | — | — | — | 0.040 |
| D | 0.241 | 1.53 | 5.20 | 22.80 | — | — | — | — | — | 0.062 |
| E | 0.146 | 0.83 | 0.36 | 12.54 | 1.64 | — | 0.32 | — | — | 0.042 |
| F | 0.134 | 0.86 | 0.42 | 12.63 | — | 1.76 | — | — | — | 0.046 |
| G | 0.133 | 0.92 | 0.38 | 12.58 | 0.98 | 0.84 | — | — | — | 0.044 |
| H | 0.131 | 1.36 | 2.52 | 12.41 | — | — | 0.36 | — | — | 0.036 |
| I | 0.124 | 1.24 | 2.46 | 12.54 | — | — | 0.32 | 0.08 | — | 0.041 |
| J | 0.126 | 0.40 | 2.54 | 12.38 | — | — | — | 0.38 | 0.10 | 0.038 |
| K | 0.121 | 0.39 | 2.56 | 12.41 | — | — | 0.20 | 0.18 | 0.05 | 0.040 |
| L | 0.462 | 0.36 | 3.59 | 15.25 | — | — | — | — | — | 0.012 |

TABLE 1-continued

| Steel | Chemical Composition (mass %, Remainder: Fe & Impurities) | | | | | | | | | |
|---|---|---|---|---|---|---|---|---|---|---|
| | C | Si | Mn | Cr | Ni | Cu | Nb | V | Ti | N |
| M | 0.364 | 2.41 | 1.54 | 23.42 | — | 3.64 | — | — | — | 0.062 |
| N | 0.246 | 0.33 | 7.80 | 15.61 | 2.58 | — | — | — | — | 0.068 |
| O | 0.283 | 0.62 | 2.31 | 28.92 | — | — | 0.68 | 0.78 | — | 0.164 |
| P | 0.138 | 0.56 | 2.38 | 13.84 | — | — | — | — | 0.84 | 0.146 |

Note:
Underline denotes outside range of the present invention.

FIG. 2A is an explanatory view showing an example of processing steps of comparative method commonly practiced (method of carrying out the solid solution heat treatment in the ferrite single phase or in the dual phase region, referred to as Method 2, hereinafter); FIG. 2B is an explanatory view showing an example of processing steps of inventive method (method of carrying out the solid solution heat treatment through the holding of the steel under heating in the austenite single phase region, and thereafter, through the holding of the steel under heating in the ferrite single phase region, referred to as Method 1, hereinafter).

As shown in FIG. 2A and FIG. 2B, each ingot cut into a predetermined shape was subjected to treatment in accordance with the following processing steps into a stainless steel plate as a test piece.

(1) Hot rolling: the hot rolling for the purpose of structure control and thickness reduction was carried out through multi-pass rolling at a rolling starting temperature of 1200° C., and at a rolling finishing temperature of at least 900° C. The plate thickness of the obtained heat-rolled steel plate was approximately 3 mm.

(2) Solid solution heat treatment: Method 1 was carried out in accordance with the present invention such that the steel was held under heating in the austenite single phase region (1020° C.), and cooled down to a room temperature, and thereafter, the steel was subsequently held under heating in the ferrite single phase region (750° C.). The holding under heating time at each temperature is shown in Table 2, and in Table 2, Time A represents holding time in the austenite single phase region, and Time F represents holding time in the ferrite single phase region. The cooling was allowing cooling after both the heating in the austenite single phase region and the heating in the ferrite single phase region. Method 2 was carried out by holding the steel under heating in the ferrite single phase region or in the dual phase region in accordance with Comparative method. Each heating temperature and each holding time are shown in Table 2. The cooling was allowing cooling in the both regions. In the both methods, pickling was carried out for descaling after the solid solution heat treatment.

(3) Cold rolling and heat treatment: the cold rolling and the heat treatment may be carried out once or plural times for reducing the thickness, softening, and structure control. These steps may not necessarily be carried out. In Inventive Example, the cold rolling was carried out once, and the heat treatment was carried out once. The target plate thickness in the cold rolling was set to be 1 mm. The heat treatment was carried out by holding the steel at 750° C. of the ferrite single phase region for three minutes, and then cooling the steel with allowing cooling.

(4) Final cold rolling and final heat treatment (quenching): the thickness of the steel was reduced to be approximately 0.3 mm of a product plate thickness, by the final cold rolling. Each obtained sheet was subjected to quenching by the final heat treatment using the heating temperature, the holding time, and the cooling rate shown in Table 2. The cooling rate was represented by an average value thereof from the heating temperature to 600° C.

Using test pieces which were taken from the steel sheets for testing with Test Nos. 1-35 that were sheets each having a sheet thickness of approximately 0.3 mm produced under various conditions shown in Table 2, the grain diameter, the structure, the $C_M/C_F$ ratio, the hardness, the tensile properties (elongation), the bending workability, and the fatigue properties were investigated in the following method. The hot workability was investigated on stainless steel sheets obtained through the hot rolling process. The measurement results thereof are comprehensively shown in Table 2, as well.

[Hot Workability]

The hot workability was evaluated by visually observing presence of edge cracks at both edges of each stainless steel sheet after the hot rolling. In Table 2, each preferable sheet having no edge crack is represented by a symbol "○", each sheet that could be used for manufacturing a plate in spite of having edge cracks is represented by a symbol "Δ", and each sheet that could not be used for manufacturing a plate because of many edge cracks is represented by a symbol "x".

[Structure]

The structure was measured on a surface of the steel sheet of each test piece using a ferrite meter. The metallurgical structure after embedding, polishing, and etching was observed on the parallel cross sectional surface in the rolling direction using an optical microscope and an SEM. Each structure identified by the above both investigations is represented by M for the martensitic single phase, represented by M+F for the mixed phase of the martensitic phase and the ferrite phase, and represented by F for the ferrite single phase in Table 2. The retained austenite phase observed in some test pieces is represented by A, and the rate thereof is also represented (in volume %).

[Grain Diameter]

The metallurgical structure after the embedding, the polishing, and the etching was observed on the parallel cross sectional surface in the rolling direction using the optical microscope and the SEM. Subsequently, the grain diameter was measured at an average portion of each piece based on the photograph thereof.

[$C_M/C_F$ Ratio]

This ratio was measured with a method using the above stated EPMA. The linear analysis with the EPMA was carried out on the parallel cross sectional surface in the rolling direction after the embedding and the polishing, and the calculation was performed in the above explained manner. Measurement points where coarse precipitate of at least 1 μm was observed were excluded. The measurement was conducted across the entire length of at least 300 μm, and the measurements points were set with intervals of 3 μm therebetween, and the measurement was made for three seconds at every measurement point.

[Hardness]

The hardness was measured on the surface of the steel sheet of each test piece using a Vickers hardness meter at 98N.

[Tensile Properties]

Elongation was measured on each of No. JIS-13B test pieces which were taken in parallel with the rolling direction, using an instron type testing machine. The 0.2% proof stress and the tensile strength were also measured, and it was confirmed that they were proportional to the hardness.

[Bending Workability]

Presence of cracking after the working was investigated on each strip piece which was taken such that its longitudinal direction was parallel with the rolling direction, using a right-angled bending die having a bend radius of 1 mm. In this evaluation, each preferable case of having no crack is represented by a symbol "0", and each case of having cracks is represented by a symbol "x", and these results are shown in Table 2.

[Fatigue Properties]

Using strip piece each of which was taken such that its longitudinal direction was parallel with the rolling direction, and had a projection so disposed at the center of the longitudinal direction as to extend vertically to the longitudinal direction, a completely reversed plane bending testing machine, where each test piece was placed with the projection parallel with the bending axis, was used for evaluating presence of cracking after $10^6$-cycle repeated bending. In this evaluation, each case of having cracks passing through the sheet is represented by a symbol "x", and the other cases are represented by a symbol "○", and these results are shown in Table 2.

TABLE 2

| | | Solid-solution Heat Treatment | | | | | Final Heat Treatment | | | | Properties After Final Heat Treatment | | | | | | | |
|---|---|---|---|---|---|---|---|---|---|---|---|---|---|---|---|---|---|---|
| | | | Method 1 | | Method 2 | | Heating | Holding | Cooling | | Grain | | | | | | | Fatigue |
| No. | Steel | [1)]Method | Time A (min) | Time F (min.) | Temp. (° C.) | Time (min) | Temp. (° C.) | Time (sec.) | Rate (° C./s) | Hot Workability | Diameter (μm) | Structure (%) | $C_M/C_F$ Ratio | Hardness (HV) | Elongation (%) | Hardness × Elongation | Bending Workability | Properties After $10^6$ Cycles |
| 1 | A | 1 | 30 | 5 | — | — | 900 | 30 | 5.0 | ○ | 9.6 | F + M | 9.2 | 376 | 9.6 | 3609.6 | ○ | ○ |
| 2 | A | 1 | 30 | 5 | — | — | 950 | 30 | 5.0 | ○ | 10.4 | F + M | 9.6 | 428 | 7.1 | 3038.8 | ○ | ○ |
| 3 | A | 1 | 30 | 5 | — | — | 1000 | 30 | 5.0 | ○ | 10.7 | F + M | 10.4 | 436 | 6.9 | 3008.4 | ○ | ○ |
| 4 | A | 1 | 30 | 1 | — | — | 950 | 30 | 5.0 | ○ | 10.4 | F + M | 8.5 | 430 | 7.0 | 3010.0 | ○ | ○ |
| 5 | B | 1 | 30 | 5 | — | — | 800 | 30 | 5.0 | ○ | 7.4 | F + M | 9.6 | 335 | 10.9 | 3651.5 | ○ | ○ |
| 6 | B | 1 | 30 | 5 | — | — | 850 | 30 | 5.0 | ○ | 8.2 | F + M | 10.2 | 394 | 9.0 | 3546.0 | ○ | ○ |
| 7 | B | 1 | 30 | 5 | — | — | 900 | 10 | 5.0 | ○ | 9.0 | F + M | 10.8 | 442 | 7.8 | 3447.6 | ○ | ○ |
| 8 | B | 1 | 30 | 5 | — | — | 900 | 30 | 1.0 | ○ | 9.1 | F + M | 10.6 | 444 | 8.1 | 3596.4 | ○ | ○ |
| 9 | B | 1 | 30 | 5 | — | — | 900 | 30 | 5.0 | ○ | 9.1 | F + M | 11.9 | 451 | 8.1 | 3653.1 | ○ | ○ |
| 10 | B | 1 | 30 | 5 | — | — | 1000 | 30 | 5.0 | ○ | 10.6 | F + M | 12.1 | 479 | 6.6 | 3161.4 | ○ | ○ |
| 11 | B | 1 | 10 | 10 | — | — | 900 | 30 | 5.0 | ○ | 9.2 | F + M | 12.3 | 466 | 8.2 | 3821.2 | ○ | ○ |
| 12 | B | 1 | 60 | 60 | — | — | 900 | 30 | 5.0 | ○ | 9.1 | F + M | 12.2 | 460 | 7.8 | 3588.0 | ○ | ○ |
| 13 | C | 1 | 30 | 5 | — | — | 850 | 30 | 5.0 | ○ | 7.6 | F + M | 16.8 | 546 | 6.3 | 3439.8 | ○ | ○ |
| 14 | C | 1 | 30 | 5 | — | — | 900 | 30 | 5.0 | ○ | 8.6 | F + M | 17.4 | 562 | 6.0 | 3372.0 | ○ | ○ |
| 15 | D | 1 | 30 | 5 | — | — | 850 | 30 | 5.0 | ○ | 7.9 | F + M + 1% A | 15.6 | 521 | 6.4 | 3334.4 | ○ | ○ |
| 16 | D | 1 | 30 | 5 | — | — | 900 | 30 | 5.0 | ○ | 9.0 | F + M + 2% A | 16.6 | 553 | 6.1 | 3373.3 | ○ | ○ |
| 17 | E | 1 | 30 | 5 | — | — | 850 | 30 | 5.0 | ○ | 6.9 | F + M + 2% A | 9.8 | 399 | 9.6 | 3830.4 | ○ | ○ |
| 18 | F | 1 | 30 | 5 | — | — | 850 | 30 | 5.0 | ○ | 7.8 | F + M | 9.4 | 390 | 9.8 | 3822.0 | ○ | ○ |
| 19 | G | 1 | 30 | 5 | — | — | 850 | 30 | 5.0 | ○ | 7.4 | F + M | 8.6 | 394 | 9.4 | 3703.6 | ○ | ○ |
| 20 | H | 1 | 30 | 5 | — | — | 900 | 30 | 5.0 | ○ | 8.8 | F + M | 9.8 | 468 | 10.1 | 4726.8 | ○ | ○ |
| 21 | I | 1 | 30 | 5 | — | — | 900 | 30 | 5.0 | ○ | 8.6 | F + N | 9.4 | 458 | 9.9 | 4534.2 | ○ | ○ |
| 22 | J | 1 | 30 | 5 | — | — | 900 | 30 | 5.0 | ○ | 8.6 | F + M | 9.7 | 466 | 9.7 | 4520.2 | ○ | ○ |
| 23 | K | 1 | 30 | 5 | — | — | 900 | 30 | 5.0 | ○ | 8.4 | F + M | 9.1 | 471 | 10.2 | 4804.2 | ○ | ○ |
| 24 | B | 2* | — | — | 800 | 30 | 900 | 30 | 5.0 | ○ | 9.0 | F + M | 4.8* | 420 | 4.6 | 1932.0 | X | X |
| 25 | B | 1 | 30 | 5 | — | — | 1050* | 30 | 5.0 | ○ | 49.9 | M | 2.1* | 462 | 3.8 | 1755.6 | X | X |
| 26 | C | 2* | — | — | 800 | 30 | 900 | 30 | 5.0 | X | 8.7 | F + M | 4.8* | 496 | 1.6 | 793.6 | X | X |
| 27 | C | 1 | 30 | 5 | — | — | 900 | 30 | 0.2* | ○ | 9.0 | F + M | 4.9* | 524 | 1.5 | 786.0 | X | X |
| 28 | C | 1 | 30 | 5 | — | — | 1050* | 30 | 5.0 | ○ | 36.8 | M | 2.9* | 589 | 0.4 | 235.6 | X | X |
| 29 | L* | 2* | — | — | 800 | 30 | 900 | 30 | 5.0 | X | 11.6 | F + M | 4.8* | 568 | 3.4 | 1931.2 | X | X |
| 30 | L* | 1 | 30 | 5 | — | — | 900 | 30 | 5.0 | Δ | 11.8 | F + M | 19.8 | 608 | 1.6 | 972.8 | X | X |
| 31 | M* | 2* | — | — | 800 | 30 | 900 | 30 | 5.0 | X | 9.2 | F + M | 4.7 | 546 | 2.1 | 1146.6 | X | X |
| 32 | M* | 1 | 30 | 5 | — | — | 900 | 30 | 5.0 | X | 9.4 | F + M | 12.3 | 584 | 2.3 | 1343.2 | X | X |
| 33 | N* | 1 | 30 | 5 | — | — | 900 | 30 | 5.0 | X | 10.4 | F + M | 16.8 | 543 | 0.9 | 488.7 | X | X |
| 34 | O* | 1 | 30 | 5 | — | — | 900 | 30 | 5.0 | X | 14.8 | F + M | 10.4 | 488 | 1.6 | 780.8 | X | X |
| 35 | P* | 1 | 30 | 5 | — | — | 900 | 30 | 5.0 | X | 8.4 | F + M | 10.2 | 494 | 1.5 | 741.0 | X | X |

[1)]Method 1 (Inventive method: heat in A-phase > heat in F-phase); Method 2 (Comparative method: heat in dual phase region or heat in F-phase);
mark "*" denotes outsidce range of the present invention.

In Table 2, Test Nos. 1-23 are Inventive Examples, and Test Nos. 24-35 are Comparative Examples having steel chemical compositions outside the range defined by the present invention (Test Nos. 29-35), or having steel structures outside the range defined by the present invention because of using different manufacturing methods from the present invention (Test Nos. 24-28).

Each of Test Nos. 1-23 of Inventive Examples exhibits a relationship between the excellent elongation (6.0-10.9%) and the excellent hardness (335-562 Hv), and also has preferable bending property and fatigue properties, which are all required in a spring member. An absolute value of a product of the hardness and the elongation indicating the balance between the hardness and the elongation is at least 3000 for each test piece, and those cases having a grain diameter of at most 10 μm exhibit a further greater value as high as at least 3300.

To the contrary, as shown in Test Nos. 24-28, although the steel chemical composition satisfies the composition defined by the present invention, if the manufacturing conditions do not satisfy the conditions of the present invention, and the ratio ($C_M/C_F$) is less than 5.0, the absolute value of the product of the hardness and the elongation is less than 2000, and the bending property and the fatigue properties are both unfavorable.

Test Nos. 29-35 that do not satisfy the Inventive compositions, and Test Nos. 29 and 31 that do not satisfy the producing conditions of the present invention are also unfavorable.

The invention claimed is:

1. A stainless steel characterized by having a chemical composition comprising, in mass %, C: 0.1-0.4%, Si: at most 2.0%, Mn: 0.1-6.0%, Cr: 10.0-28.0%, N: at most 0.17%, and a remainder of Fe and impurities, and by having a metallurgical structure which includes a mixed phase structure of a ferrite phase and a martensitic phase, or of the ferrite phase and the martensitic phase as well as a retained austenite phase of at most 5% in volume %, and satisfies a relationship of $C_M/C_F \geq 5.0$ where an average C content existing in the ferrite phase is defined as $C_F$, an average C content existing in the martensitic phase is defined as $C_M$.

2. The stainless steel as set forth in claim 1, wherein an average grain diameter of the mixed phase structure is at most 10 μm.

3. The stainless steel as set forth in claim 1, wherein the chemical composition further has one or more elements selected from Ni: at most 2%, Cu: at most 2%, Nb: at most 0.5%, V: at most 0.5%, and Ti: at most 0.5%, in mass %.

4. A method for manufacturing stainless steel having the chemical composition as set forth in claim 1 characterized by subjecting the stainless steel to hot and cold working, and subsequent heat treatment at least once respectively; and thereafter to final cold working into a product shape, and subsequent final heat treatment for performance adjustment, and further characterized by carrying out heat treatment prior to the final cold working by holding the stainless steel under heating in an austenite single phase region for at least ten minutes, and subsequently holding the stainless steel under heating in a ferrite single phase region for at least one minute; and carrying out the final heat treatment after the final cold working by holding the stainless steel under heating at a temperature in a dual phase region of a ferrite phase and an austenite phase within a range of 800-1000° C. for at least ten seconds, and subsequently cooling the stainless steel at a cooling rate of at least 1° C./second down to at least 600° C.

* * * * *